US008857659B2

(12) United States Patent
Gauthier

(10) Patent No.: US 8,857,659 B2
(45) Date of Patent: Oct. 14, 2014

(54) BUTTON CELL BATTERY DISPENSER PACKAGE

(75) Inventor: Jonathan C. Gauthier, Bennington, VT (US)

(73) Assignee: Eveready Battery Company, Inc., St. Louis, MO (US)

( * ) Notice: Subject to any disclaimer, the term of this patent is extended or adjusted under 35 U.S.C. 154(b) by 288 days.

(21) Appl. No.: 13/635,690

(22) PCT Filed: Mar. 7, 2011

(86) PCT No.: PCT/US2011/027347

§ 371 (c)(1), (2), (4) Date: Sep. 26, 2012

(87) PCT Pub. No.: WO2011/115762

PCT Pub. Date: Sep. 22, 2011

(65) Prior Publication Data

US 2013/0015197 A1 Jan. 17, 2013

Related U.S. Application Data

(60) Provisional application No. 61/315,163, filed on Mar. 18, 2010.

(51) Int. Cl.
*B65D 83/04* (2006.01)

(52) U.S. Cl.
CPC ..... *B65D 83/0454* (2013.01); *B65D 2585/88* (2013.01)
USPC ..... 221/122; 206/704

(58) Field of Classification Search
CPC .. B65D 83/0454; B65D 83/04; B65D 75/366; B65D 85/88; B65D 73/0092
USPC ..... 221/121, 122, 133; 206/471, 704
See application file for complete search history.

(56) References Cited

U.S. PATENT DOCUMENTS 3,995,767 A 12/1976 Brindley et al.
4,078,661 A 3/1978 Thomas (Continued)

FOREIGN PATENT DOCUMENTS

DE 19803348 A1 8/1999
WO 01/87732 A1 11/2001

OTHER PUBLICATIONS

Patent Cooperation Treaty (PCT), International Search Report and Written Opinion for Application No. PCT/US2011/027347, filed Mar. 7, 2011, mailed Jul. 1, 2011, European Patent Office, Netherlands.

*Primary Examiner* — Timothy Waggoner
(74) *Attorney, Agent, or Firm* — Russell H. Toye, Jr.

(57) ABSTRACT

The invention is a button cell battery dispensing package (10) including a display card with front panel (12) and rear panel (30) and a flanged cover rotatably disposed with its flange (60) between the front and rear panels (1230). The cover (50) has blisters forming cavities (54) in which the batteries are disposed, with the blisters (56) protruding through an opening in the front panel. The cover (50) has one or more rearward projections (52) that can project into the cutouts (48) in the rear panel (30), to prevent free rotation of the cover (50) and hold a cavity in position adjacent to a battery access opening (36) to facilitate removal of a battery from the cavity (54). The cover (50) can be manually rotated by the user to sequentially index cavities into position adjacent to a battery access opening. The package (10) can include a door that can be closed to retain a cell in a cavity (54) adjacent to the battery access opening or opened to allow removal of the battery.

22 Claims, 2 Drawing Sheets

(56) References Cited

U.S. PATENT DOCUMENTS

| | | | | |
|---|---|---|---|---|
| 4,953,700 | A | 9/1990 | DeDino | |
| 6,364,155 | B1 | 4/2002 | Wolfe | |
| 6,631,825 | B2 | 10/2003 | Garrant et al. | |
| 6,659,281 | B2 * | 12/2003 | Gaffney et al. | 206/704 |
| 6,805,258 | B2 * | 10/2004 | Cross | 221/25 |
| 6,889,840 | B2 * | 5/2005 | Schein et al. | 221/122 |
| 6,938,775 | B2 * | 9/2005 | Gaffney et al. | 206/704 |
| 2003/0155276 | A1 | 8/2003 | Gaffney et al. | |

* cited by examiner

BUTTON CELL BATTERY DISPENSER PACKAGE

RELATED APPLICATIONS

This application is a national stage entry of international Application No. PCT/US2011/027347, filed Mar. 7, 2011, which claims the benefit of U.S. Provisional Application No. 61/315,163, filed Mar. 18, 2010.

BACKGROUND

This invention relates to dispenser packages for button cell batteries, particularly button air cell batteries.

Handling of button cell batteries can be difficult because of their small size. This is particularly true for consumers with limited manual dexterity. Furthermore, it may be desirable for the user to be able to carry spare batteries in a pocket or purse, especially for use in electronic devices such as hearing aids. Small button cell dispenser packages have been used to provide users with a supply of batteries that will protect the batteries, can be conveniently carried and from which batteries can be dispensed one at a time.

An example of a button air cell cell dispenser package is disclosed by DeDino in U.S. Pat. No. 4,953,700. This package has a molded plastic casing with a plurality of battery compartments arranged in a circular path. The plastic casing is rotatably mounted on a display card via a stud or post extending from the plastic casing. The plastic casing can be rotated to position a battery in one of the compartments in alignment with a discharge outlet in the rear panel of the display card so the battery can be removed from the package when the reclosable discharge outlet is opened. A disadvantage of this package is that the display card and plastic casing are somewhat flexible, and the package can be bent such that a gap through which the batteries can fit is created between the display card and plastic casing. This can result in the batteries spilling from the package or pilferage of batteries from the package during display in a retail store. The plastic casing can also rotate freely, and if the discharge outlet is not kept closed after the package has been opened by the user, individual batteries can be inadvertently moved into alignment with the discharge outlet and fall out of the package.

Attempts have been made to prevent loss and theft of the batteries from the dispenser package. One example is found in U.S. Pat. No. 6,631,825 (Garrant et al.), which discloses a product dispenser with a rigid cover enclosing button cell batteries secured to a rigid base with an adhesive layer. The cover has an opening in the side wall and can be rotated with respect to the base to position a battery adjacent to the opening such that the battery can be advanced, using a slidable push element, from the interior of the dispenser, through the opening, to a landing on the exterior of the cover. The push element can also be locked in place to prevent inadvertent rotation of the dispenser and loss of batteries through the opening. The batteries are securely contained within this dispenser, and the adhesive layer and lockable push element retain the batteries except during dispensing, but the dispenser contains more components, assembly is more complicated and the packaging cost is greater than DeDino's package.

Another example of a button air cell battery dispenser package that securely contains the batteries to prevent spillage and pilferage is disclosed by Gaffney et al. in US Patent Publication No. 2003/0155276. As in DeDino's package, this package includes a flexible display card and a plastic cover with a plurality of battery compartments rotatably mounted to the display card via a post extending from the plastic cover. To prevent spillage and pilferage of the batteries between the card and cover, a plastic backing is interposed between the cover and card, with a peripheral lip of the backing overlapping with the peripheral flange of the cover. The cover and backing are sufficiently rigid to prevent spillage and pilferage of the batteries from between the cover and card. The backing is also held in place on the card by a pair of anchors so the backing does not rotate with the cover, and the backing cooperates with the cover to prevent free rotation of the cover and provide indexing of the battery compartments to the discharge outlet in the display card. This package also has more components and assembly is more complicated than DeDino's package.

Yet another example of a button air cell battery dispenser package that prevents spillage and pilferage of batteries from between the display card and the plastic casing/cover is disclosed by Koch et al. in International Publication No. WO 01/877332. This package also includes a flexible display card and a rotatable plastic container (casing or cover). Rather than being secured to the front surface of the card with a stud or post extending from the cover, the plastic cover projects through a front panel of the display card and the peripheral flange of the cover is trapped between the front panels and another panel of the display card, so that sealed edges of the display card panels enclose the casing flange to prevent spillage and pilferage between the display card and the cover. However, indexed rotation of the plastic casing is not provided and inadvertent rotation of the cover is not prevented, so batteries can inadvertently fall through the discharge outlet if the discharge outlet is not kept closed. Furthermore, if the batteries are oriented with the cell sealing tabs against the rear display card panel, the cells can rotate so the tabs do not all extend in the desired directions, creating an undesirable appearance, even if the cavities in the cover in which the batteries are contained are shaped to accommodate the batteries with the tabs extending in the desired directions, because the tabs can move to a small space between the cover and the rear panel.

In U.S. Pat. No. 6,889,840, a blister package, similar to the package disclosed in International Publication No. WO 01/877332, is provided with a means to control rotation of the rotatable member (insert) in which the button cell batteries are disposed. The front panel of the display card (cover) has radial protrusions that protrude into the opening in the cover through which the rotatable insert projects. The protrusions are spaced to roughly correspond to the width of the cell compartments. The protrusions can cooperate with the peripheral portions of the cell compartments to hold a cell compartment adjacent to the opening in the rear panel of the display card (carrier) for removal of a cell from the compartment. Rotational force applied to the insert by the user can overcome friction preventing free rotation of the insert to index another cell compartment adjacent to the opening in the rear panel of the card. However, variability in the dimensions of the insert and the front panel of the card can result in undesired rotation of the insert or require excessive rotational force to index the insert.

Other attempts have been made to provide dispenser packages in which products can be sequentially indexed into position for removal of product. Examples include U.S. Pat. Nos. 6,805,258; 6,364,155 and 4,078,661. All of these attempts have one or more disadvantages, such as relatively expensive component parts, additional component parts and more complicated manufacturing processes compared to conventional blister pack packages In view of the above, the present invention provides a dispensing package for button cell batteries that can be used to dispense batteries one at a time, that is easy and economical to manufacture, that prevents spillage, pilferage and inadvertent loss of batteries from the package, and that provides a package with an attractive appearance that will appeal to consumers.

SUMMARY

The above objects are met and the above disadvantages of the prior art are overcome by providing a button cell battery dispenser that has a small number of components, completely encloses the batteries to prevent their loss from between a cover and a display card, and maintains the desired orientation of the cell sealing tabs in the package.

Accordingly, an aspect of the invention is a button cell battery dispensing package including a display card comprising a first panel and a second panel, a cover having a peripheral flange and a central area, and a plurality of button cell batteries. The first panel of the display card has a front surface, a rear surface, and an inside edge defining an opening therethrough, and the second panel of the display card has a rear surface, a front surface facing the rear surface of the first panel, and a battery access opening therethrough. The cover has a front surface, a rear surface, a plurality of equally spaced blisters protruding from the front surface thereof, and a plurality of cavities in the rear surface thereof corresponding to the blisters protruding from the front surface of the cover. The batteries are disposed in the cavities in the cover, and the cover is rotatably disposed with its peripheral flange between the first and second panels and with at least portions of the blisters protruding through the opening in the first panel. The cover has at least one projection from its rear surface, and the second panel of the display card has a plurality of equally spaced cutouts therethrough, the cutouts corresponding to the cavities in the cover such that the at least one projection from the rear surface of the cover will project into a cutout when a cavity is positioned adjacent to the battery access opening to prevent free rotation of the cover in at least one direction.

Embodiments of can include any of the following features, either alone or in various combinations:

the cover has a plurality of projections from its rear surface;

the second panel has a cutout corresponding to each of the cavities such that when any one of the cavities is positioned adjacent to the battery access opening, the at least one projection from the rear surface of the cover projects into one of the cutouts in the second panel; the cover can have a projection from the rear surface of the cover corresponding to each of the cavities in the cover such that when any one of the cavities is positioned adjacent to the battery access opening, each of the projections from the rear surface of the cover projects into one of the cutouts in the second panel;

the cutouts are complete cutouts, or they can be partial cutouts comprising flaps that remain attached to the second panel;

the battery access opening in the second panel comprises score lines along which a portion of the second panel can be separated from the remainder of the second panel to create a door with a living hinge that can be opened and closed; an edge of the door can be tucked into a slot in the first panel to hold the door closed, or the door can be held closed by adhesive tape;

the first and second panels are formed from a single sheet folded along a common edge; the second panel can be a two-part panel, with each part formed by folding along a common edge with the first panel further comprising a third display card panel disposed against the rear surface of the second panel; the third panel and at least one of the first and second panels can be formed from a single sheet folded along a common edge, or it can be formed from a different sheet from the first panel or the second panel; at least a portion the third panel can be folded away from the second panel to expose at least a portion of the rear surface of the second panel; the third panel can comprise a door that covers the battery access opening when the third panel is in a closed position and exposes the battery access opening when the third panel is in an open position;

at least one of the display card panels is made from a paper material;

at least one of the display card panels is made from a sheet of polymeric material;

the cover is made from a sheet of polymeric material;

the cover is a thermoformed cover;

each of the batteries is an air cell battery with a housing having at least one air access opening covered by an adhesive tab.

These and other features, advantages and objects of the present invention will be further understood and appreciated by those skilled in the art by reference to the following specification, claims and appended drawings.

Unless otherwise specified herein, all disclosed characteristics and ranges are as determined at room temperature (20-25° C.).

DESCRIPTION

Figure 1:
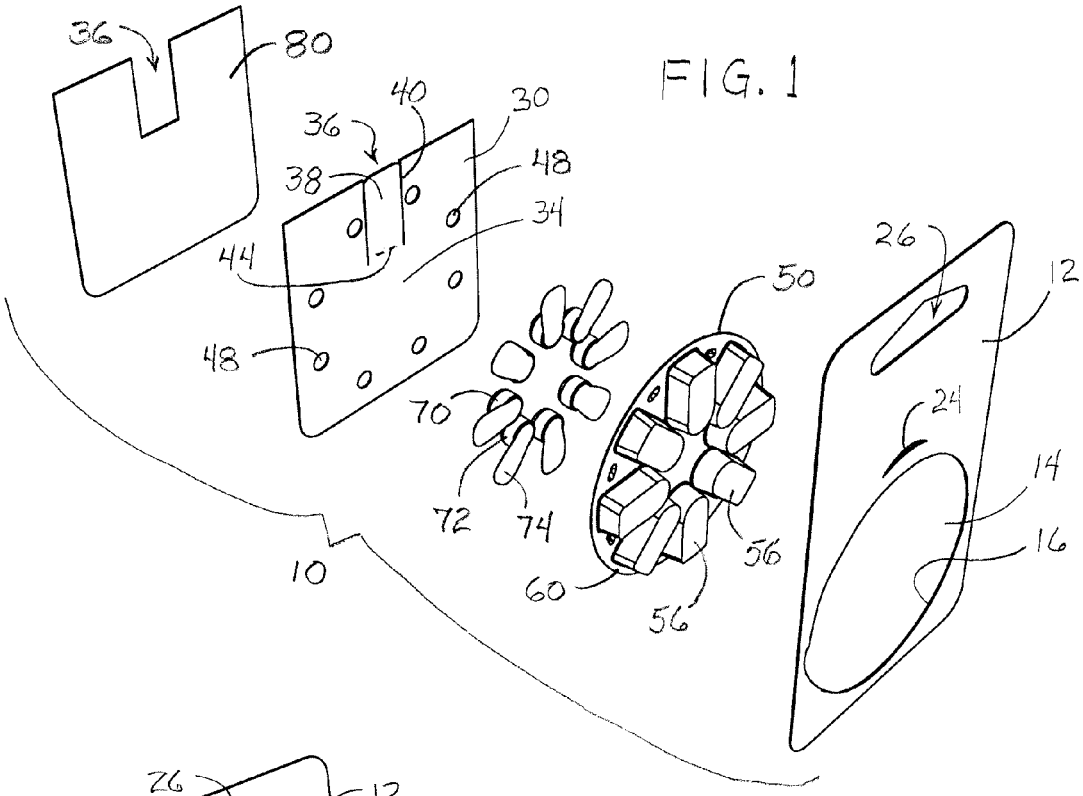
FIG. 1 is an exploded left front perspective view of a first embodiment of a button cell battery dispensing package.

A battery dispensing package according to the invention is for dispensing small button cell batteries, such as watch, calculator and hearing aid batteries. A button cell battery is a small round battery having an overall height that is less than its diameter. Button cell batteries can be of any known type, including but not limited to aqueous and nonaqueous electrolyte batteries, alkaline and acidic electrolyte batteries, primary and rechargeable batteries, fuel cell batteries, and batteries with a variety of negative electrode active materials (such as zinc, magnesium, aluminum, hydrogen and lithium) an positive electrode active materials (such as manganese dioxide, nickel oxyhydroxide, silver oxide, mercuric oxide, oxygen and iron disulfide). The invention is especially useful for devices using air cell batteries that have to be replaced periodically, and having replacement batteries readily available to the user is desirable. An example of such devices is a hearing aid. A common type of hearing aid battery is an alkaline zinc/air cell battery.

A button cell battery dispensing package according to the invention includes a multi-panel display card and a rotatable cover. The cover has a central area with equally spaced cavities in which the batteries are placed (e.g., with the cavities facing the rear of the package), corresponding blisters projecting from the opposite surface of the cover, and a peripheral flange. The cover flange is disposed between the two (e.g., front and rear) panels of the display card, with at least portions of the blisters projecting through an opening, preferably a round opening, in one panel. This opening can be in either the front panel or the rear panel, but for convenience, the opening through which the blisters project is referred to below as the rear panel. The adjacent surfaces of the front and rear panels of the display card are attached to each other so that no gaps through which a cell can fit will occur between the rear panel and the cover flange, even if the package is bent or distorted. Batteries can be removed (dispensed) from the package one at a time by rotating the cover relative to the display card to position a cavity containing a battery adjacent to a battery access opening in the rear panel of the display card, removing the battery, and repeating the process. The battery access opening can be covered when a battery is not being dispensed, thereby preventing batteries from falling out of the package if a battery is inadvertently positioned adjacent to the battery access opening.

It is desirable that cover of the button cell battery dispensing package not rotate freely. As used herein, the phrase "rotate freely" means to rotate without being manually rotated by a user to dispense a battery. Without a positive means of holding the cover in place, the cover can rotate freely when the button cell battery dispensing package is being handled or carried by the consumer, particularly if the flexible display card is flexed or distorted, because friction between the cover flange and the adjacent panels of the display card may not reliably hold the cover so it does not rotate without being rotated by the user. The button cell battery dispensing package includes such a positive means of holding the cover in place unless it is manually rotated by the user and is referred to herein as an indexing feature. The indexing feature prevents free rotation of the cover and allows indexing of the cavities into alignment with (adjacent to) the battery access opening, facilitating battery dispensing and preventing loss of batteries from the package if the battery access opening is left open. Because the cover does not rotate freely, when a battery is positioned adjacent to the battery access opening for dispensing, the battery remains in this dispensing position without the consumer having to manually hold the cover in place, and no batteries will fall out of the package through the battery access opening when an empty cavity in the cover is positioned adjacent to the battery access opening if the battery access opening is not closed. Accordingly, as used herein the phrase "prevent free rotation" means to minimize free rotation such that when a cavity is indexed into alignment with the battery access opening, any free rotation of the cover that occurs is small enough that a battery in the cavity remains in position for removal through the battery access opening so there will be essentially no interference between the battery and the side edges (the edges normal to the rotational motion of the cover) of the battery access opening.

The indexing feature includes at least one projection from a surface of the cover adjacent toward a surface of one of the display card panels, preferably the rear panel, and a plurality of equally spaced cutouts in the panel toward which the projection projects. The cutouts are positioned so that when any one of the battery cavities is aligned with the battery access opening so that a battery in that cavity can be removed, the cover projection projects into one of the cutouts to prevent free rotation of the cover. Friction holds the projection in the cutout, but the friction can be overcome when the user applies a rotational force to the cover, allowing the user to index an adjacent cavity into alignment with the battery access opening. Preferably there is one cutout corresponding to each battery cavity, though other embodiments are possible, such an elongated cutout corresponding to an adjacent pair of cavities (i.e., half the number of cutouts compared to the number of cavities), so that the one battery cavity is aligned with the battery access opening when a projection is at one end of the elongated cutout and an adjacent battery cavity is aligned with the battery access opening when that projection is at the other end of the elongated cutout. The number of projections is at least one, but there can be more than one, such as one corresponding to each battery cavity, so that when any one of the battery cavities is aligned with the battery access door, each projection is able to project into one of the cutouts. More than one cutout and/or more than one projection can also be used to provide intermediate positions for the cover, so the cover can be positioned so none of the cavities are aligned with the battery access opening. This can prevent loss of batteries through the battery access opening when each cavity contains a battery, even if there is no door covering the battery access opening or if the battery door is inadvertently opened. For example, there can be two cutouts and either one or two projections corresponding to each cavity in the cover, one cutout per cavity when a cavity is aligned with the battery access opening and one cutout per cavity when no cavity is aligned with the battery access opening.

The button cell battery dispensing package can include a door that can open and close to cover the battery access opening when closed and expose the battery access opening when open. The door can be a part of the panel in which the battery access opening is located, or it can be part of a another display card panel, as described in examples below. A door can advantageously prevent a battery from falling out of the package when not intended, such as when a cavity containing a battery is inadvertently aligned with the battery access door. The door can be held in the closed position by any suitable means, including but not limited to tucking an edge of the door into a slot in one of the panels or securing the door with an adhesive (preferably a non-permanent adhesive), a piece of adhesive tape, VELCRO or another fastening device.

Each panel of the display card can include one or more layers, and panels and layers can be made from the same or different materials. Suitable materials include woven and nonwoven fiber materials such as paperboard, fiberboard, chipboard, particle board and fiberglass sheets; impregnated, coated or laminated fiber sheets; and plastics such as molded, thermoformed or extruded monomer or polymer sheets and films. Preferably the panels are made from inexpensive materials such as paperboard, fiberboard and chipboard. The panels can be somewhat flexible but must be of sufficient strength to maintain the integrity and appearance of the package and batteries. The panels can also be printed with decorations and information. The panels can be separate sheets or they can be different sections of a single sheet that is folded or otherwise formed into two or more sections. For example, a sheet can be folded into two sections to form front and rear panels that are joined along a common edge, with a surface of the section forming the rear panel facing the rear surface of the section forming the front panel. The common edge can be a side, bottom or top edge of the display card. In another example, a sheet can be folded into three sections—a center section, a left section and a right section. The left and right sections can be folded back to form a three-panel display card, or if the left and right sections are smaller than the center section, the left and right sections can be folded so their non-folded edges meet to form the rear panel of the display card. Further examples of a single sheet being folded to form two or more panels of a display card are disclosed in International Publication No. WO 01/877732.

The cover can be made of any suitable material that can be formed to provide the desired projections, cavities and so on. The material must provide sufficient strength and rigidity to maintain its shape and integrity and to contain the batteries. In general, inexpensive materials are desirable. Preferred materials are plastics, including one or more monomers, polymers, copolymers and combinations thereof. Preferred plastics include polyethylene terephthalate, polybutylene terephthalate, polytrimethylene terephthalate, polyvinyl chloride, polyethylene, polypropylene, polyether ether ketone, polysulfone, polystyrenes, bioplastics such as polylactic acid, and so on. The cover material can be translucent or clear so the batteries and printing on the front surface of the rear panel are visible through the cover from the front of the package. Common methods of making the cover are thermoforming, molding and extruding.

Figure 2:
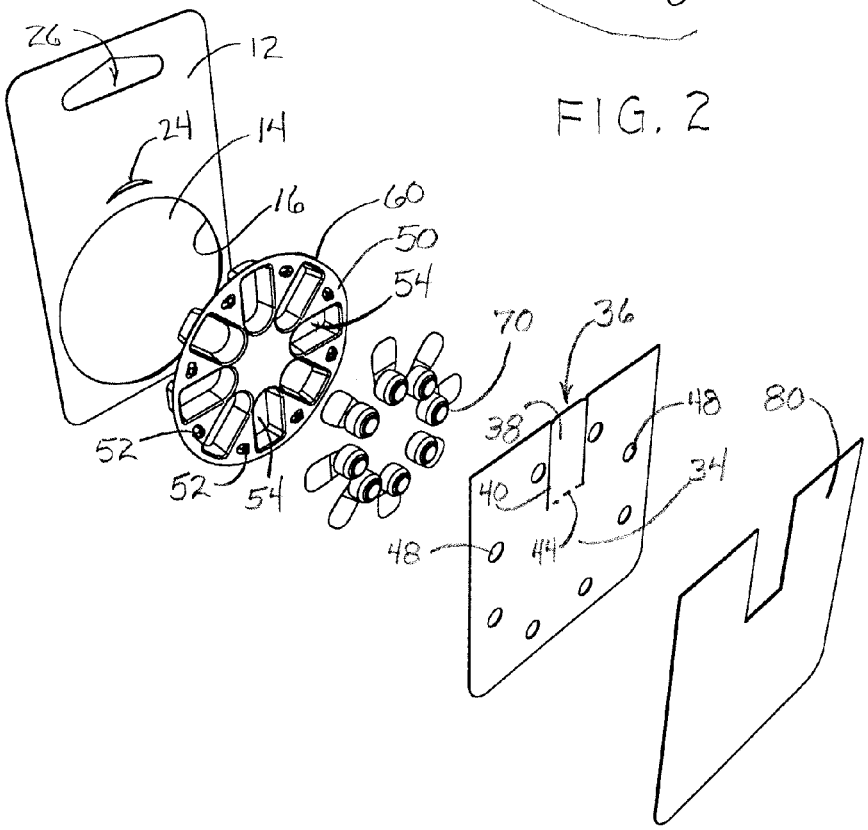
FIG. 2 is an exploded right rear perspective view of the button cell battery dispensing package shown in FIG. 1.

An embodiment of the invention is shown in FIGS. 1 and 2, which are exploded perspective views of the dispensing package and batteries, as seen from the left front and right rear, respectively. The terms front, rear, left, right and so on are relative spatial terms based on a package orientation as shown in FIG. 1 and are used only for convenience; the package may be oriented in any direction without changing the relationships of the parts to one another. The dispensing package 10 has a front panel 12 and a rear panel 30. The front panel 12 has an opening 14 defined by an inside edge 16. The rear panel 30 has a battery access opening 36, through which batteries 70 can be removed. Located between the panels 12, 30 is a cover 50 having blisters 56 protruding from its front surface. These blisters 56 correspond to cavities 54 in the rear surface of the cover 50. The batteries 70 are disposed within the cavities 54. The cover 50, containing batteries 70, is disposed between the front and rear panels 12, 30 with the blisters 56 extending through the opening 14 in the front panel 12 and a cover flange 60 sandwiched between the panels 12, 30.

Figure 4:
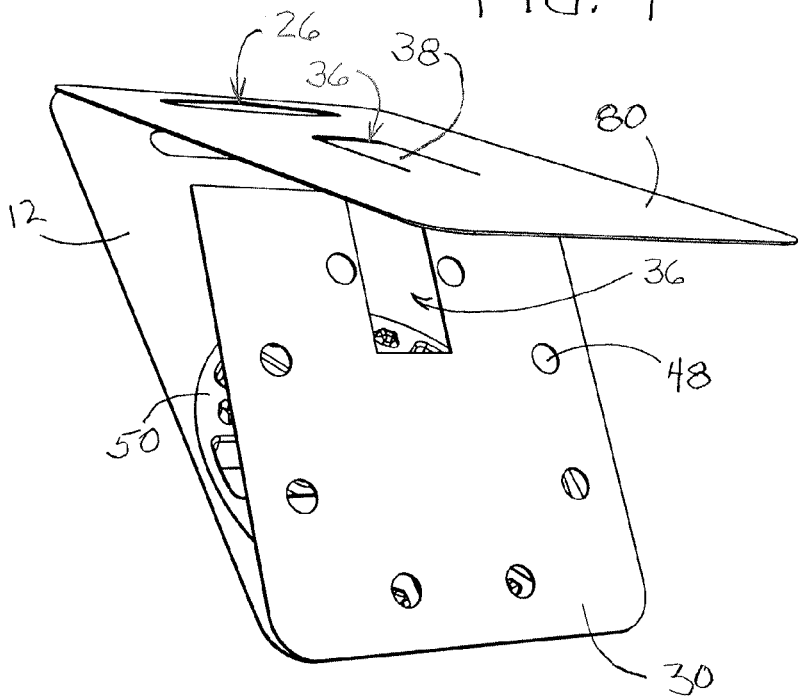
FIG. 4 is a right rear perspective view of a third embodiment of a button cell battery dispensing package.

To dispense a battery 70 from the package, the cover 50 is manually rotated to index it to a dispense position (rotated to position a cavity 54 containing a battery 70 adjacent to the battery access opening 36). With a cavity 54 and battery 70 aligned with the battery access opening 36, the battery 70 can be removed through the battery access opening 36. The blisters 56 protruding through the opening 14 in the front panel 12 can be grasped by the user to manually rotate the cover 50, or an outward projecting handle 62 can be formed in or attached to the cover 50 to facilitate gasping and rotating the cover 50. The battery access opening 36 can be covered when batteries 70 are not being dispensed. The battery access opening covering can be a door 38. In one embodiment the door 38 can be formed by cutting frangible score lines 40 in the rear panel 30. The door 38 can include a living hinge 44. After the door 38 has been initially opened, the top edge of the door 38 can be tucked into a slot 24 cut in the front panel 12 when batteries 70 are not being dispensed to hold the door 38 in the closed position, or the door can be held in the closed position by some other means, such as with a piece of tape with a non-permanent adhesive. As an alternative to or in combination with the door 38, the battery access opening 36 can be covered with a piece of a material such as adhesive tape, plastic film, cardboard or the like that can be at least partially removed to allow removal of the battery 70. In one embodiment the battery access opening 36 can be covered with a third display card panel 80, as shown in FIG. 4 and explained in further detail below.

In the embodiments shown in FIGS. 1, 2, 3 and 4, the cover 50 includes a rearward projection 52 corresponding to each cavity 54, and the rear display card panel 30 has one cutout 48 for each projection 52. The cavities 54, projections 52 and cutouts 48 are all equally spaced and positioned so that when any of the cavities 54 is aligned with the battery access opening 36, each of the projections 52 extends into one of the cutouts 48. Friction holds the projections 52 in the cutouts 48 to prevent free rotation of the cover 50, but the frictional forces can be overcome when the user manually rotates the cover 50. In this way the cover can remain in position, without rotating, while a cavity 54 containing a battery 70 is positioned adjacent to the battery access opening 36 and the user removes (dispenses) the battery. With an empty cavity 54 aligned with the battery access opening 36, free rotation of the cover 50 is prevented so batteries 70 do not spill from the package, even if the battery access opening 36 is not covered. The cooperation of the projections 52 and the cutouts 48 also provides an indexing feature that helps the user to align cavities 54 and batteries 70 with the battery access door for dispensing.

The packages in FIGS. 1 through 4 include eight cover cavities 54, with a battery 70 in each cavity 54, but the number of cavities 54 can be more or less than eight, and each cavity 54 does not have to contain a battery 70. The package can also include a hanger hole 26 in the at least one of the panels 12, 30, 80 from which the package 10 can be hung and displayed in a retail store.

The batteries 70 are button cell batteries, such as watch batteries, coin cell batteries or hearing aid batteries, for example. Hearing aid batteries typically include a cell 72 with an adhesive tab 74 covering air access holes in the cell housing. The air access holes can be located on a substantially flat surface of the cell 72, with the tab 74 extending beyond the diameters of the batteries 70. The batteries 70 can be positioned in the cavities 54 so the tabs 74 are adjacent to either the front surface of the rear panel 30 of the display card or the rear surface of the cover 50. It may be desirable to keep the batteries 70 oriented in a particular manner, such as with the tabs 74 all extending radially inward or radially outward. Each of the cavities 56 can include a cell portion generally shaped to correspond to the shape of the button cell 72 and an extending tab portion generally shaped to accommodate the tab 74 when it is oriented in the desired direction. With the batteries 70 positioned in the cavities 54 with the tabs 74 adjacent to the rear surface of the cover 50, the positions of the batteries 70 can be easily maintained with the tabs 74 oriented as desired.

Figure 3:
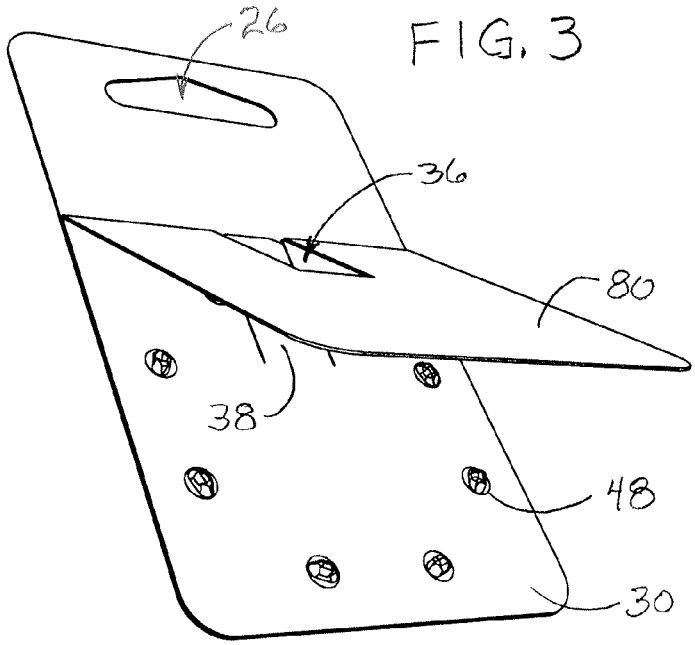
FIG. 3 is a right rear perspective view of a second embodiment of a button cell battery dispensing package.

As described above, the button cell battery dispensing package 10 can include one or more panels in addition to panels 12 and 30. In the embodiment shown in FIGS. 1 and 2, the package 10 includes a third panel 80 adjacent to the rear surface of display card panel 30. The third panel 80 can be a fixed panel, to hide the cutouts 48 and make more space available on the back of the package for graphics for example, or it can be a moveable panel. A moveable panel can function as a covering for the battery access opening 36, in addition to or instead of door 38 in panel 30, and it can also provide additional display card surface area for graphics on its front surface. The third panel 80 can have essentially the same outside dimensions as panel 30, or it can have a different size and shape. The third panel 80 can be a separate panel with at least a portion of the third panel 80 attached to the rear surface of panel 30, with an adhesive, for example, or it can be formed from the same sheet as panel 12 or panel 30 by folding the sheet along a common edge, such as the top edge of panel 80 in FIG. 4. In one embodiment the third panel 80 can be folded away from the rear surface of panel 30 to provide access to the battery access opening 36 in panel 30. In another embodiment panel 80 can include a battery access opening 36 and optionally a door 38, as shown in FIGS. 3 and 4.

When the package is assembled, the panels of the display card between which the cover flange is disposed are attached to each other. They are attached in sufficient numbers and sizes of areas that the batteries will not slip between the cover flange and the panel behind the cover and come out of the package. The panels can be attached by a common folded edge or with an adhesive. Preferable adhesives are permanent adhesives so the bond between the panels is not easily broken. Examples of types of adhesives that can be used include heat-seal adhesives, pressure sensitive adhesives, hot melt adhesives, bioadhesives (e.g., starch and casein), epoxies, rubber cements, cyanoacrylates, and so on. It may also be desirable to attach the panels around at least a major portion of the perimeter of the display card.

All references cited herein are expressly incorporated herein by reference in their entireties. To the extent publications and patents or patent applications incorporated by reference contradict the disclosure contained in the present specification, the present specification is intended to supersede and/or take precedence over any such contradictory material.

It will be understood by those who practice the invention and those skilled in the art that various modifications and improvements may be made to the invention without departing from the spirit of the disclosed concept. The scope of protection afforded is to be determined by the claims and by the breadth of interpretation allowed by law.

The invention claimed is:

1. A button cell battery dispensing package 10 comprising a display card comprising a first panel 12 and a second panel 30, a cover 50 comprising a peripheral flange 60 and a central area, and a plurality of button cell batteries 70; wherein:

the first panel 12 of the display card has a front surface, a rear surface, and an inside edge defining an opening therethrough;

the second panel 30 of the display card has a rear surface, a front surface facing the rear surface of the first panel, and a battery access opening therethrough;

the cover 50 has a front surface, a rear surface, a plurality of equally spaced blisters protruding from the front surface thereof, and a plurality of cavities in the rear surface thereof corresponding to the blisters protruding from the front surface of the cover;

the batteries 70 are disposed in the cavities in the cover;

the cover 50 is rotatably disposed with its peripheral flange 60 between the first and second panels and with at least portions of the blisters protruding through the opening in the first panel;

the cover has at least one projection 52 from its rear surface;

the second panel of the display card has a plurality of equally spaced cutouts 48 therethrough, the cutouts 48 corresponding to the cavities in the cover such that the at least one projection from the rear surface of the cover will project into a cutout when a cavity is positioned adjacent to the battery access opening to prevent free rotation of the cover in at least one direction.

2. The button cell battery dispensing package as defined in claim 1, wherein the cover has a plurality of projections from its rear surface.

3. The button cell battery dispensing package as defined in claim 1, wherein the second panel has a cutout corresponding to each of the cavities such that when any one of the cavities is positioned adjacent to the battery access opening, the at least one projection from the rear surface of the cover projects into one of the cutouts in the second panel.

4. The button cell battery dispensing package as defined claim 1, wherein the cover has a projection from the rear surface of the cover corresponding to each of the cavities in the cover such that when any one of the cavities is positioned adjacent to the battery access opening, each of the projections from the rear surface of the cover projects into one of the cutouts in the second panel.

5. The button cell battery dispensing package as defined in claim 1, wherein the cutouts are complete cutouts.

6. The button cell battery dispensing package as defined in claim 1, wherein the cutouts are partial cutouts comprising flaps that remain attached to the second panel.

7. The button cell battery dispensing package as defined in claim 1, wherein the battery access opening in the second panel comprises score lines along which a portion of the second panel can be separated from the remainder of the second panel to create a door 38 with a living hinge 44 that can be opened and closed.

8. The button cell battery dispensing package as defined in claim 7, wherein an edge of the door can be tucked into a slot in the first panel to hold the door closed.

9. The button cell battery dispensing package as defined in claim 7, wherein the door can be held closed by adhesive tape.

10. The button cell battery dispensing package as defined in claim 1, wherein the first and second panels are formed from a single sheet folded along a common edge.

11. The button cell battery dispensing package as defined in claim 1, wherein the second panel is a two-part panel, with each part formed by folding along a common edge with the first panel.

12. The button cell battery dispensing package as defined in claim 1 further comprising a third display card panel disposed against the rear surface of the second panel.

13. The button cell battery dispensing package as defined in claim 12, wherein the third panel and at least one of the first and second panels are formed from a single sheet folded along a common edge.

14. The button cell battery dispensing package as defined in claim 12, wherein the third panel is not formed from the same sheet as the first panel or the second panel.

15. The button cell battery dispensing package as defined in claim 12, wherein at least a portion the third panel can be folded away from the second panel to expose at least a portion of the rear surface of the second panel.

16. The button cell battery dispensing package as defined in claim 15, wherein the third panel comprises a door that covers the battery access opening when the third panel is in a closed position and exposes the battery access opening when the third panel is in an open position.

17. The button cell battery dispensing package as defined in claim 1, wherein at least one of the display card panels is made from a paper material.

18. The button cell battery dispensing package as defined in claim 1, wherein at least one of the display card panels is made from a sheet of polymeric material.

19. The button cell battery dispensing package as defined in claim 1, wherein the cover is made from a sheet of polymeric material.

20. The button cell battery dispensing package as defined in claim 1, wherein the cover is a thermoformed cover.

21. The button cell battery dispenser as defined in claim 1, wherein each of the batteries is an air cell battery with a housing having at least one air access opening covered by an adhesive tab.

22. The button cell battery dispenser as defined in claim 1, wherein the batteries are disposed in the cavities in the cover with the adhesive tabs adjacent to the rear surface of the cover.

* * * * *